US005107583A

United States Patent [19]

Gustafsson

[11] Patent Number: 5,107,583

[45] Date of Patent: Apr. 28, 1992

[54] METHOD FOR THE MANUFACTURE OF TUBULAR ELEMENTS

[75] Inventor: Peter O. Gustafsson, Gothenburg, Sweden

[73] Assignee: Telefonaktiebolaget L M Ericsson, Stockholm, Sweden

[21] Appl. No.: 697,393

[22] Filed: May 9, 1991

[30] Foreign Application Priority Data

Jun. 6, 1990 [SE] Sweden ..... 9002016

[51] Int. Cl.[5] ..... H01P 11/00

[52] U.S. Cl. ..... 29/600; 29/424; 333/239

[58] Field of Search ..... 29/600, 423, 424; 333/239

[56] References Cited

U.S. PATENT DOCUMENTS

| | | | |
|---|---|---|---|
| 3,314,130 | 4/1967 | Sheridan . | |
| 3,686,590 | 8/1972 | Dischert | 29/600 X |
| 3,955,274 | 5/1976 | Imai et al. | 29/600 |
| 4,885,839 | 12/1989 | Ben-Dov | 333/239 X |

*Primary Examiner*—Carl J. Arbes

*Attorney, Agent, or Firm*—Burns, Doane, Swecker & Mathis

[57] ABSTRACT

The present invention relates to a method of manufacturing a two-part, thin-walled tubular element, particularly waveguides, to close tolerances. The inventive method comprises the steps of bending or pressing thin material in a manner to produce the parts (1, 2) of said element, wherein at least one of the parts (2) is provided with a shoulder-like projection (3) for joining said parts together; inserting the first part (1) into a first tool-half (4) which functions as a counter-pressure means and which has accurately determined internal dimensions; pressing the second part (2) together with the first part (1), wherein the formed element has a smaller vertical extension than the finished element; pressing a second tool-half (6) over the second part (2) and into abutment with the first tool-half (4), this second tool-half (6) functioning as a counter-pressure device and having accurately determined internal dimensions, wherein at least one of the tool-halves (6) is provided with means (7) which is operative in squeezing the join-forming surfaces of the element parts together into a lightly squeezed sealing connection; by introducing a foaming filler (8) into the assembled tool (4, 6) and between the element part (1, 2) and permitting the filler to expand so as to press the element parts outwardly against respective accurately-dimensioned tool-halves 4, 6); permitting the filler (8) to solidify to a core so that the element can be removed from the tool; sealing the lightly squeezed connection (3) to form a secure joint; and removing the foamed core from the finished tubular element.

9 Claims, 4 Drawing Sheets

METHOD FOR THE MANUFACTURE OF TUBULAR ELEMENTS

TECHNICAL FIELD

The present invention relates to a method for the manufacture of two-part, thin-walled tubular elements, particularly waveguides, to close tolerances.

BACKGROUND ART

Various methods are known for the manufacture of tubular elements, such as waveguides. An example of one such method is aluminium extrusion. This method enables tubular elements to be produced with sufficient accuracy and at relatively low cost, provided that the wall thicknesses of said elements are greater than 1 mm. The drawback with this known method, however, is that the element produced is relatively heavy. Because of the nature of the process involved, a reduction in wall thickness, and therewith a reduction in weight, will result in a pronounced increase in the number of elements that must be scrapped because the tolerances no longer can be maintained within set limits. Furthermore, it is not possible to subsequently work such elements without subjecting them to significant deformation, which also increases the percentage of scrapped elements.

DISCLOSURE OF THE INVENTION

The object of the present invention is to provide a method for manufacturing tubular elements with great accuracy. This object is achieved by using an expanding filler as a working component in combination with an outer counter-pressure means to dimension and fixate component parts and to function as a support for continued working of the element.

The inventive method affords the advantage of providing an element with satisfactory tolerances and of low weight at defensibly low production costs. The element can also be subsequently worked without risk of harmful deformation.

Other objects of the invention and advantages afforded thereby will be evident from the following detailed description, which is made with reference to a preferred exemplifying embodiment thereof and with reference to the accompanying drawings.

BEST MODE OF CARRYING OUT THE INVENTION

There will now be described a method for manufacturing a two-part tubular, thin-walled element. The description is directed to the manufacture of a ridge waveguide, although it will be understood that other types of tubular elements with other cross-sectional shapes, such as rectangular for instance, can be manufactured in accordance with the inventive method. Waveguides are preferably made of aluminium, although they can also be made of other electrically conductive materials, preferably of low specific weight. Other types of tubular elements may, of course, be made from other types of material, such as different types of plastic materials.

Figure 1:
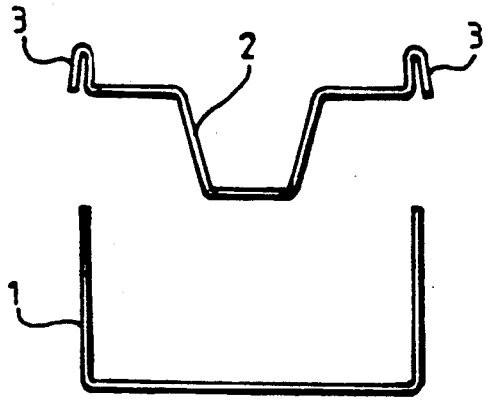
FIGS. 1-9 illustrate schematically the various procedural steps of a method for manufacturing tubular elements to close tolerances in accordance with the invention.
Figure 2:
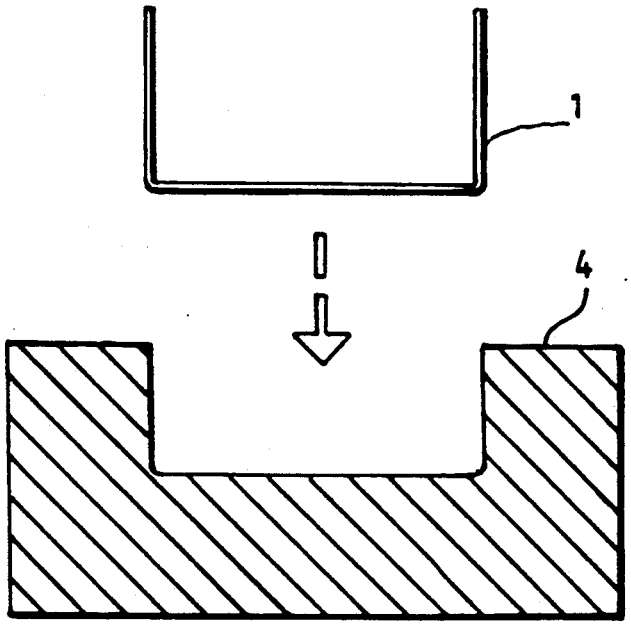
Figure 3:
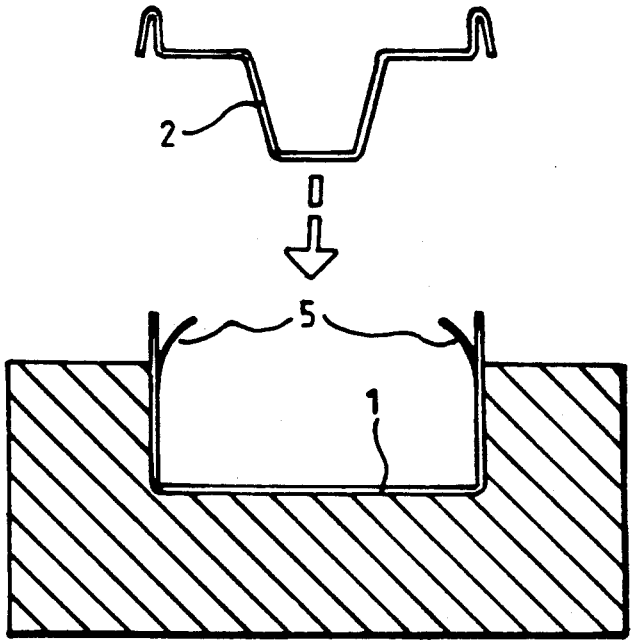

FIG. 1 illustrates the first step in the manufacture of a waveguide comprising a bottom part 1 and a top part 2 made from thin aluminium sheet and bent or pressed to a given shape with a wall thickness of 0.3–0.6 mm, for instance. This results in high-precision components. The top part is also provided with shoulders-like projections 3, which enable the parts to be mutually joined together. The pre-shaped bottom part 1 is then placed in a bottom tool-half 4 which has precise internal dimensions, FIG. 2. FIG. 3 illustrates the step of applying a protective film 5 onto the bottom part 1, either by gluing or by using a self-adhesive film, so as to protect the join between said parts and to prevent the ingress of filler. This is particularly important in the case of waveguides, since it is necessary to ensure good electrical contact between the waveguide parts. The top part 2 is then pressed down against the bottom part 1. The now formed waveguide has a smaller vertical extension or height than the ultimate finished element.

Figure 4:
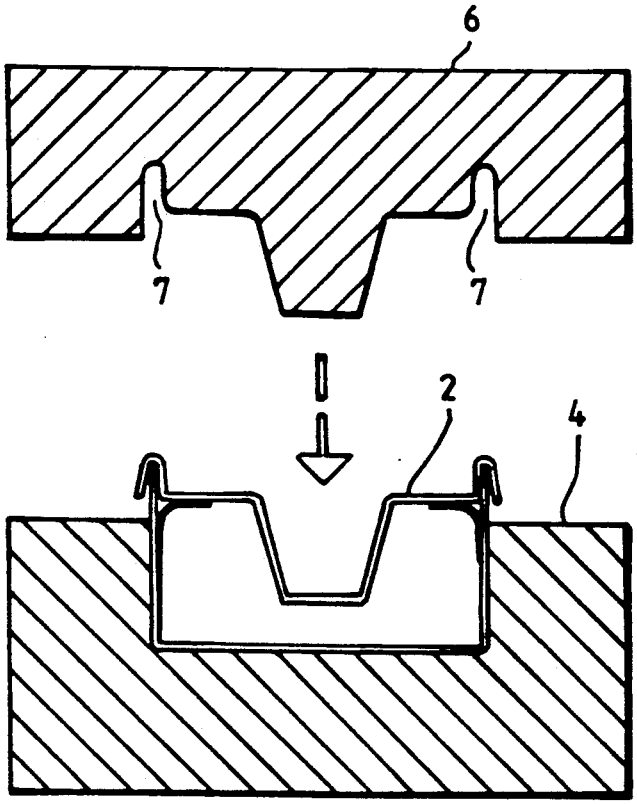
Figure 5:
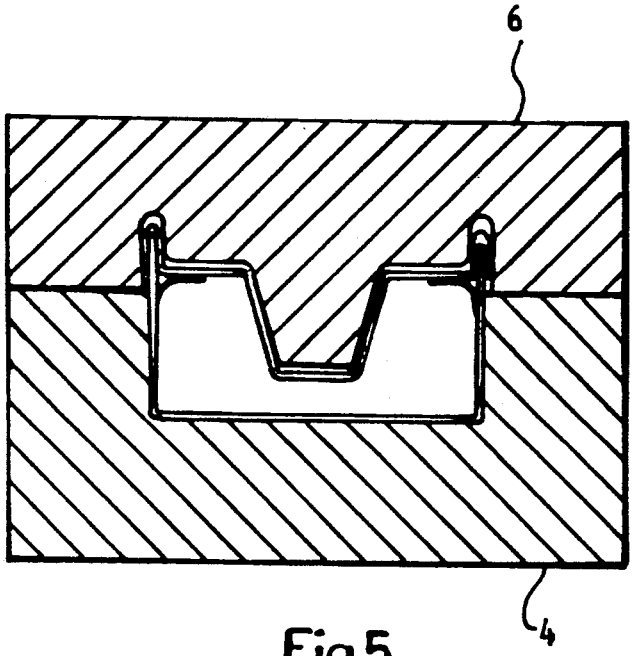

FIG. 4 illustrates the next step of manufacture, in which an upper tool-half 6 is pressed down over the bottom element part 2 until coming into abutment with the bottom tool-half 4. The upper tool-half 6, similar to the tool-half 4, is configured with accurate internal dimensions and is also provided with means 7 which squeeze together the joint-forming shoulders 3 so as to form a lightly squeezed sealing connection between the element parts 1 and 2. In this stage of the manufacturing process, the two tool-halves 4 and 6 are screwed together to the position illustrated in FIG. 5. FIG. 5 also illustrates the sealing connection and the manner in which the protective film 5 covers the joint region between the parts 1 and 2. As will also be seen from the Figure, the upper part 2 is fitted in the tool-half 6 such as to present a clearance therewith, i.e. the height of the formed element is smaller than the internal dimensions of the tool.

Figure 6:
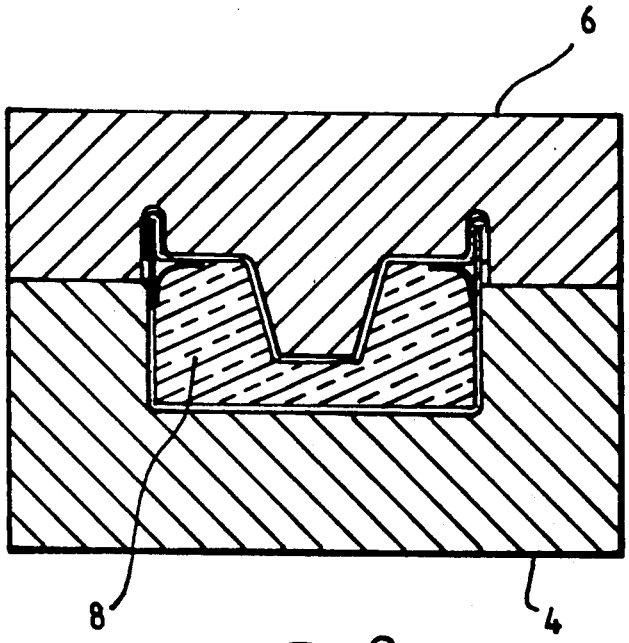
Figure 7:
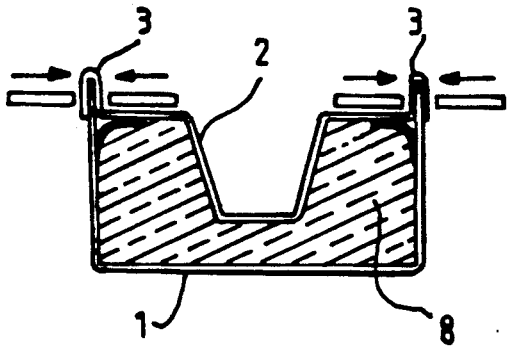

In the next step of the manufacturing process, a filler 8, for instance polyurethene, is introduced into the tool 4, 6 between the element-parts 1 and 2, FIG. 6, and foamed therein. This causes the bottom part 1 and the top part 2 of the element to be pressed against their respective tool-halves 4 and 6 and to be shaped so as to provide an integrated element of precise dimensions. The foam is then allowed to solidfy. It is important that the tool is not opened prematurely during this manufacturing stage, since premature opening of the tool would cause the pressure exerted by the expanding foam to bulge-out the walls of the waveguide and therewith destroy the element. Thus, it is imperative that the tool is not opened and the waveguide removed before the foam has propertly solidified to form a core. The removed waveguide is now finally effectively sealed along the lightly squeezed connection 3 by some appropriate method, such as spot welding, seaming or like techniques, to form a secure join, as illustrated schematically in FIG. 7. The expanded foam core within the waveguide ensures that the waveguide will retain its shape during this working process, with only local deformation.

Figure 8:
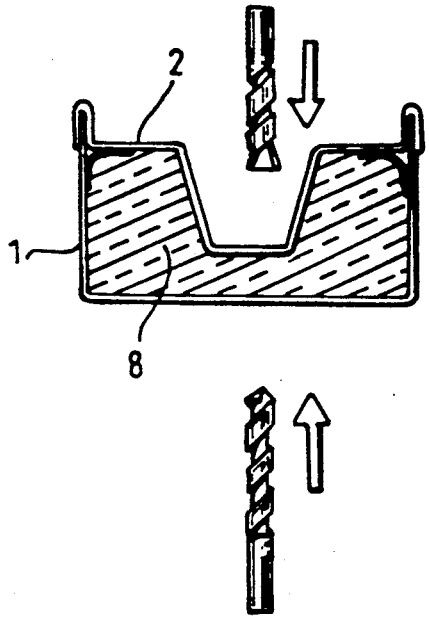
Figure 9:
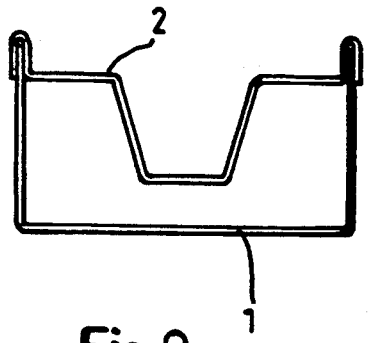

FIG. 8 illustrates a method by means of which holes can be formed in the waveguide with the expanded core still present therein. The holes can be made with the aid of any appropriate conventional method, such as boring, milling or the like without risk of deformation, since the core forms a support for the material being worked during the hole-forming process. The last stage of manufacture involves removing the core, so that the finished element, shown in FIG. 9, can be used for the purpose intended. The method used to remove the core depends on the material from which the core is made. The method used will preferably be a non-mechanical method, so as not to influence the waveguide mechanically, for instance a method in which the core is dissolved with the aid of a solvent, acid or the like, and therewith readily removed. It is also conceivable, however, to press the core mechanically from the waveguide in its axial direction, if this can be effected without requiring the application of excessive force that is liable to act negatively on the waveguide.

The described method enables a tubular element to be produced to close tolerances in a simple and reliable fashion and with high repeatability. The foamed core ensures that the element will not be subjected to deformation during mechanical process, such as hole-forming processes or the like.

It will be understood that the invention is not restricted to the aforedescribed and illustrated embodiment thereof and that modifications can be made within the scope of the following claims.

I claim:

1. A method of accurately forming a tubular member having an inner surface and an outer surface by joining and shaping a first elongated deformable part and a second elongated deformable part, comprising the steps of:

inserting said first part in a first tool half of specified dimensions that surrounds an outer surface of said first part;

lightly press-fitting said second part together with said first part such that edges of said first part extend within corresponding seam-forming channels of said second part;

pressing over said second part a second tool half of specified dimensions that surrounds an outer surface of said second part such that said first and second tool halves abut and said seam-forming channels are lightly squeezed;

introducing a tumescent foaming filler into a hollow formed by inner surfaces of said first and second parts;

allowing said filler to expand, pressing said first and second parts against said first and second tool halves;

allowing said filler to solidify, forming a removable core;

securely joining said first and second parts along said seam-forming channels; and removing said core.

2. The method of claim 1 wherein said step of securely joining comprises applying at least one of heat and pressure to said seam-forming channels sufficient to fuse said first and second parts.

3. The method of claim 2 wherein said seam-forming channels are spot welded.

4. The method of claim 2 wherein said seam-forming channels are swaged.

5. A method according to claim 1, comprising the further step of applying a protective film to one of the parts prior to pressing said parts together, in order to protect the joint area from the ingress of filler.

6. A method according to claim 1, comprising the further step of forming at least one hole in the tubular member prior to removing the foamed core.

7. A method according to claim 1, comprising the further step of screwing the tool halves together prior to expansion and solidification of the filler.

8. A method according to claim 1, wherein said removing step includes dissolving the foamed core with the aid of a caustic substance, to facilitate removal of said core.

9. A method according to claim 1, wherein said removing step comprises removing the foamed core by pushing said core axially from said tubular member.

* * * * *